United States Patent [19]

Galvin et al.

[11] Patent Number: 4,468,664

[45] Date of Patent: Aug. 28, 1984

[54] NON-HOME RUN ZONING SYSTEM

[75] Inventors: Aaron A. Galvin, Lexington; John K. Guscott, Lynnfield; Martin E. Henderson, Wayland; Roy L. Harvey, Lexington, all of Mass.

[73] Assignee: American District Telegraph Company, New York, N.Y.

[21] Appl. No.: 338,839

[22] Filed: Jan. 12, 1982

Related U.S. Application Data

[63] Continuation of Ser. No. 151,969, May 21, 1980, abandoned.

[51] Int. Cl.[3] ..... G08C 19/00; G08B 1/00

[52] U.S. Cl. ..... 340/825.69; 340/505; 340/512; 340/531; 340/533; 340/825.04; 340/825.54

[58] Field of Search ..... 340/533, 531, 506, 508, 340/509, 518, 522, 525, 534, 535, 825.69, 537, 825.54, 825.52, 825.57, 825.59, 825.6, 825.64, 825.66, 825.65, 825.68, 825.62, 825.06, 825.07, 825.09, 825.10, 825.11, 825.12, 825.13, 825.14, 825.15, 825.18, 825.2, 825.21, 825.29, 505, 512, 825.04

[56] References Cited

U.S. PATENT DOCUMENTS 3,737,858 6/1973 Turner et al. ..... 340/870.19
3,927,404 12/1975 Cooper ..... 340/533

FOREIGN PATENT DOCUMENTS 1105973 3/1968 United Kingdom .
1427133 3/1976 United Kingdom .
1462052 1/1977 United Kingdom .

OTHER PUBLICATIONS

Aritech Bulletins, Feb. 1981, Jul. 1980, Aug. 1979, Aritech Corp.

*Primary Examiner*—Donnie L. Crosland
*Attorney, Agent, or Firm*—Weingarten, Schurgin, Gagnebin & Hayes

[57] ABSTRACT

Zone indication is provided for a facility monitoring and control system by providing the system's sensors and control unit with counters which are simultaneously incremented with clock pulses delivered to the sensors via the multi-wire interconnect cable from the system's control unit. Each sensor output circuit has enabling circuitry connected, as with jumper pins, to a counter output corresponding to a predetermined number or count, and this number or count identifies the sensor. In one embodiment, each sensor output is enabled only during the occurrence of the corresponding count or number from its counter as the counters are incremented through their cycle. When the sensors are used to sense alarm conditions, the sensor sending an alarm signal is identified when an alarm condition signal exists simultaneously with a particular count from the counter at the control unit, with the particular count indicating which sensor is sending the alarm signal. When zone indication is utilized in conjunction with remote data gathering, data is transmitted between counter clock pulses. Should transmission of complex data be required, the counter clock pulses are inhibited and complex data is then read out from the sensor actuated when the counter clock pulses are inhibited, with the complex data read out at a rate governed by a different type of pulsed signal transmitted to the sensor. In one embodiment, zone indication signals are made compatible with sensor control signals so as to establish compatibility with previously installed in-place systems. This greatly facilitates retrofitting existing systems with non-home-run zoning.

24 Claims, 6 Drawing Figures

NON-HOME RUN ZONING SYSTEM

This is a continuation of application Ser. No. 151,969 filed May 21, 1980, now abandoned.

FIELD OF INVENTION

This invention relates to facility monitoring and control systems employing multiple sensors, and more particularly to a zone annunciation or indication system, which indicates the location of a monitored zone while utilizing only the cable normally supplied for the multiple sensor system.

BACKGROUND

While this invention relates broadly to facility monitoring and control systems in which data collected at remote locations is transmitted to a central control unit over a cable, the subject invention will first be described in connection with multi-wire intrusion detection systems in which the data to be transmitted back to the control unit is of a relatively simple nature. In terms of alarm signals indicating intrusion, the signal sent back to the control unit may merely be the presence of a pulse to indicate that an alarm condition has occurred. Ordinarily there is no further information needed because the sensors at the remote locations are all of a similar type; that is they detect only one type of alarm condition.

As will be discussed hereinafter, the subject invention also encompasses transmission of more complex data which may include discrimination between different types of alarms such as fire or intrusion and in a further embodiment, the monitoring of room temperatures, boiler pressure, elevator operation, emergency lighting, etc.

However, in its least complicated aspect, the subject zone indication system is first described in terms of the annunciation of an intrusion.

In multi-wire intrusion detection systems, in which numbers of sensors are connected in parallel to a multi-wire cable, when an intrusion or tampering is detected, it is often times difficult to ascertain the location of the intrusion or the tampering site. Thus, if a guard or other responsible personnel is to respond to an alarm indication, it is difficult to know where the breach of security occurred and therefore it is difficult to know how to respond.

Annunciator systems in the past have required a separate cable or set of cables in order to indicate the side of the alarm condition. Running multiple wires in addition to those already utilized for the intrusion detection system is both costly and sometimes impossible depending on the installation.

Audible alarms at the site of the intrusion or security breach while giving an audible indication of the breach location are often times ineffective in that they give the would be intruder sufficient warning to escape. Moreover, these systems measures to prevent capture which may endanger the security personnel investigating the breach. Additionally, audible alarms at the sensor location are ineffective to alert security personnel to the loction of the intrusion if the central control unit is not within bearing of all of the individual transceivers or sensors.

In order to provide zone indication with an in-place multi-wire cable, a digital coding system might be utilized in which each of the transceivers connected to the multi-wire cable would be given a different address code which could be polled by the central unit on a time shared basis, with the central unit generating a series of codes which when detected by a particular receiver unit would result in the coupling of the transceiver unit output to the multi-wire cable system. This of course would require considerable code recognition circuitry, and code generating circuitry. Training for the installers of such systems would additionally be complicated by knowledge of the code and code setting procedures. Moreover, some means would be necessary to separate out the zone code signals from the command signals normally utilized to control the individual sensors connected to the multi-cable line. Command signals are ordinarily digital in nature and are thus little different from the digital signals which would be sent in order to poll a given sensor.

It might be thought that a better type of zone indication system which would utilize the existing cables would be one in which polling was accomplished acoustically or at least at acoustic frequencies, with each sensor being assigned a predetermined audio frequency. Tuning fork frequency determining elements could conceivably be utilized in the sensor such that the sensors could be polled by an acoustic signal of the appropriate frequency.

However, it will be appreciated that the generation of multiple differing acoustic frequencies is both expensive and electronically somewhat complicated, as is the filtering system necessary to filter out the responses from the sensor in terms of the acoustic subcarrier which would be utilized. Moreover, since ultrasonic equipment is sometimes utilized at the sensor to detect intrusion, crosstalk could occur between the ultrasonic devices and the acoustic devices in the annunciator system.

In the digitally encoded systems described above, or in the acoustically encoded system described, the false alarm rate is unduly high in view of the aforementioned crosstalk between sensor/command signals and zone indication signals transmitted on the same lines. If separate lines are utilized for zone indication, system costs greatly increase if such a system were in fact feasible for a given location.

SUMMARY OF THE INVENTION

In one aspect of the subject invention, a "non-home-run" zone indication system is provided in which the term "non-home-run" means that no separate wires are utilized when providing zone indication. In these systems, simultaneously clocked counters are utilized in a central control unit and in the sensors. Coincidence of counts in the control unit and sensor designates the sensor which is actuated during the counter cycle. Thus, the only additional circuitry necessary for each sensor is a counter, in which a designated counter output is coupled as by a removeable jumper pin to the remainder of the sensor circuitry to actuate it. This makes retrofitting an in-place system for zone indication exceptionally easy. The use of a local counter and a jumper pin to actuate and establish the identity of a particular sensor is an exceedingly easy coding device, requiring minimal installer training.

ALARM CONDITION DETECTION

In one embodiment, an annunciator board is provided which has indicator lights or the like which are one each associated with a given counter output. The counter in the control unit is clocked or incremented simultaneously with the counters in the sensors, with an output of a given sensor being enabled only when an output signal appears on a designated output of its counter. Each sensor enabling system is coupled to a different counter output terminal. During a counter cycle the sensors are sequentially enabled so as to couple an alarm indicating signal to one of the multi-wire lines. Signals on this line are applied in parallel to a number of multi-terminal AND gates in the control unit. These AND gates are associated one each with an output terminal of the counter in the control unit. The outputs of the AND gates drive respective indicators on the annunciator board. Should a particular sensor have an output indicating an alarm condition, the simultaneous arrival of a signal from this sensor along with a corresponding control unit counter output causes the corresponding AND gate to produce a signal to light a light or give some other indication at the annunciator board. The alarm condition indication is latched or preserved so that while coincidence of a counter output signal and a sensor signal only lasts for one clock pulse, the indicator is left on indicating the particular sensor which has an output signal indicating an alarm condition.

It is therefore only necessary to provide each sensor with a pulse detection circuit, a counter and an AND gate, with one input terminal of the AND gate being coupled to an intrusion detector output, a second input terminal of the AND gate being coupled to a corresponding output terminal of its associated counter, and a third input terminal of the AND gate coupled to the output of the pulse detector, such that upon coincidence of all three signals an output signal is applied to the multi-wire cable back to the control unit. It will thus be appreciated that an alarm signal for a given sensor is available only during one clock pulse, and it is the coincident time of arrival of this particular output from the AND gate with respect to an output from the counter in the control unit which designates which of the sensors is sending the alarm-indicating signal.

In one embodiment, the alarm-indicating signal is coupled back to the control unit along the same wire which is utilized normally to power the detector. For ultasonic detectors, this wire carries a high frequency signal. It will be appreciated that a pulse is readily distinguishable from a high frequency signal through filtering. Thus at the control unit there is little difficulty in ascertaining the zone or location of the alarm condition by virtue of filtering out the high frequency signal thereby leaving the pulse from the AND gate of the sensor which is transmitting an alarm signal. In this latter embodiment, there is little crosstalk.

The system described is extremely inexpensive since it utilizes only some very simple counters along with multi-terminal AND gates. It does not require complicated digital code deciphering modules nor does it require acoustic apparatus for use in zone indication.

Moreover, as will be discussed, retrofitting a previously installed in-place system with non-home run zoning is made easy by making the zone indicating signals compatible with the already existing signals used for the in-place system. Thus, for example, in one embodiment, the clock for the multi-wire intrusion alarm cable may be the same clock utilized to send so called "freeze" pulses to the sensor. Thus, no additional pulse generating or clocking circuitry is necessary and these signals are detected at each sensor during normal operation.

Redundancy for alarm indications can be accomplished by providing that an alarm condition is indicated not only by the condition of a signal on the alarm wire, but also is indicated by a signal from a particular AND gate on another wire such as the high frequency wire.

The foregoing has assumed that the alarm condition signal is placed on the line only during the occurrence of an alarm condition. As will be described, the alarm condition signal may in fact be the absence of a normally occurring signal which is removed in accordance with a sensed alarm condition or is a result of the cutting or severing of the lines in the multi-wire cable. This offers a degree of anti-tamper protection in which the severing of the line and the removal of the signal is in itself an alarm condition which can be monitored by the subject system.

FACILITY MONITORING

While the subject system has thus far been described in terms of an alarm condition detection circuit, it will be appreciated that alarm condition detection is only one of the many remote conditions which can be monitored and annunciated by the subject system.

For instance, in facility monitoring and control systems, there may be three different types of data, e.g. alarm data, logged data and control data. Alarm data may be the occurrance of any dangerous situation such as boiler overpressure. Logged data may include recording of energy consumption. Control data includes data which is analysed so that a control function may be exercised. Thus room temperature may be monitored for furnace control.

It is important to be able to collect remote data without the necessity of providing complicated modems or digital encoding and to be able to conveniently select and program the sensors, so that they may provide for a variety of different remote data collection and control functions.

In addition to the building monitoring and automation or control systems, security functions may also be provided. For instance, the system may be programmed so as to be able to ascertain when fire detectors and burglar alarm detectors are used, which of the particular devices has been actuated. This is important insofar as the ability to determine whether the Fire Department should be called or the Police Department.

Secondly, there are some sensors which are to be actuated on a twenty-four hour per day basis whereas there are other sensors which are to be actuated only at night or some time when activity is not expected. Thus, for instance, windowfoil-type intrusion detection is often times to be monitored twenty-four hours a day, whereas ultrasonic motion detectors would be constantly going off during the business hour time period. it is therefore important to be able to conveniently select on which basis the sensors are monitored.

Another function which may be required is the provision of an entry or exit delay versus an instantaneous alarm. This feature is ordinarily provided to enable one to arm the system and then exit with the system being actuated at a given time after the arming. Likewise, the alarm which would ordinarily trip upon entry in a protected area, may be inhibited for a given delay period in order to allow an authorized person to inactivate the alarm system.

Moreover, there may be instances where for redundancy purposes an alarm is to be rendered only when there is another sensor providing the same alarm condition indication. Thus, it is important to be able to program the sensor to either provide an alarm condition signal instantaneously or alternatively only when a redundant second signal is present.

There may be an occasion where it is desirable to provide that the remote sensor provide a local alarm at the sensor location. This is to be contrasted with the silent alarm situation in which all of the alarm condition indicating is done at the control unit.

Provision of a so-called "sonalert" pre-warning reminder may be a desirable feature when the authorized person needs to be reminded that the system is on.

Of course, there may be different alarms such as would indicate a hold-up versus a burglary.

As part of the subject invention, it is possible during the clocking of the sensor-carried counters, which function as address counters, to inhibit the generation of clock pulses and provide for the generation of a second set of clock pulses to strobe a further or auxiliary counter in each sensor. The outputs of this auxiliary counter are connected respectively, as by jumper pins, to the circuits which provide for the functions described. Thus, after a predetermined sensor has been addressed by address clocking pulses, these clocking pulses can be inhibited and the auxiliary counter in the sensor clocked, with information transfer taking place when during the clocking of this auxiliary counter a particular further function circuit is actuated.

Each sensor may contain a security or alarm condition set of functions followed by data gathering and control functions. Alternatively, the sensor may be specifically tailored for either security functions or data gathering functions. In terms of data monitoring, if three conditions are monitored, corresponding sensors may be polled with the clocking of the auxiliary counter. If only one of the three conditions is to be monitored at a given sensor, only the corresponding jumper pin is inserted. In terms of security condition monitoring, a jumper pin may be inserted to give the control unit an indication, for instance, that the sensor is a 24 hour per day sensor. As an example, in one embodiment, on the first auxiliary clock pulse, the alarm condition sensor is coupled back to the control unit. Then after a predetermined number of auxiliary counter clock pulses, the insertion of a jumper pin results in an indication that the alarm is a 24 hour alarm.

For data gathering functions, the information transmitted back to the control unit may be an analog signal and in a preferred embodiment is a current proportional to the sensed condition. The providing of a current based system as opposed to a voltage based system eliminates the need for compensation due to the length of interconnect cable and is in general less subject to error.

While it is sometimes desireable to inhibit the address clock pulses, often times simplified data may be transmitted in the interval between the address clock pulses. Thus, no inhibiting is necessary for data which is not complex. In general, some primary data may be handled in this manner, while complex data may require inhibiting of the address clock.

The clock pulses for address and auxiliary functions may be distinguished by using positive going pulses for the address clock and negative going pulses for the auxiliary function clock.

DESCRIPTION OF DRAWINGS

The invention will be fully understood from the following detailed description taken in conjunction with the accompanying drawings in which.

DETAILED DESCRIPTION

Figure 1:
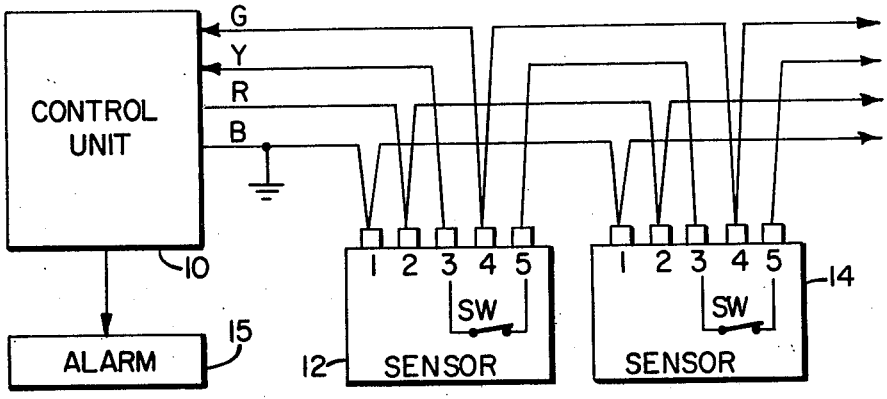
FIG. 1 is a block diagram of an intrusion alarm system utilizing a multi-wire cable in which a number of sensors are connected in parallel thereacross.

Referring now to FIG. 1, a typical multi-wire intrusion alarm system includes a control unit 10 and a number of sensors, here illustrated by reference characters 12 and 14, coupled in parallel across the wires of the multi-wire interconnect system illustrated. In the system illustrated, tamper switches SW are located within the sensors and are opened responsive to tampering with a sensor housing.

In one type multi-cable system, the four wires function as follows: the bottom line, the black wire labeled B, is utilized as the ground or return for the system; the red line labeled R, is utilized to provide DC power to the sensors; the yellow line, labeled Y, is typically utilized to transmit high frequency signals, for instance, to power ultrasonic devices within a sensor and may also be utilized for an anti-temper and bridging alarm indication, signal, which is a DC signal superimposed on the AC signal delivered over the yellow line; and, the green line, labeled G, is utilized both to provide command signals to the sensors for latching, resetting, and freeze functions and for carrying an alarm indicating signal back to control unit 10. In the case of an alarm signal developed on the green line, this is typically accomplished by the grounding of the green line which is sensed at the control unit such that alarm unit 15 is actuated. This alarm unit may be actuated either by the grounding of the green line or by an indication of tampering as detected on the yellow line.

As mentioned hereinbefore, while the providing of an alarm indication is effective to indicate that an intrusion has occurred, the location of the intruder is in doubt.

Figure 2:
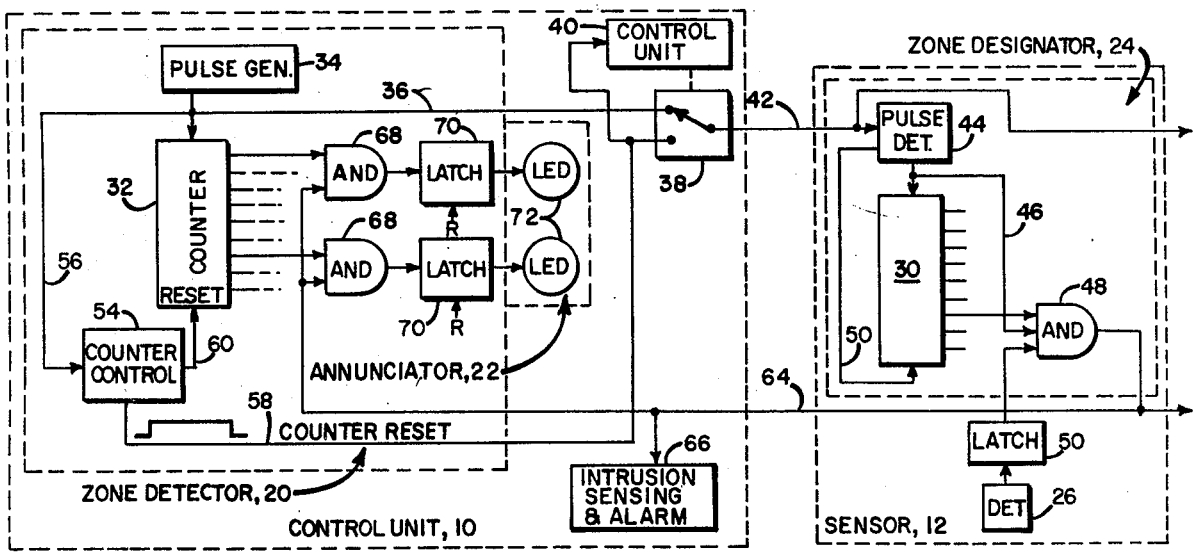
FIG. 2 is a schematic and block diagram of one embodiment of the zone indicating system illustrating a zone designator block within a sensor, a zone detector block within a control unit and an annunciator panel.

In order to provide an inexpensive zone indicating system without the utilization of complicated addressing schemes, and referring now to FIG. 2 in one embodiment, a control unit 10 is provided with a zone detecting circuit 20 and an annunciator panel 22 connected to the zone detecting circuit. A sensor here illustrated at 12 is provided with a zone designator 24 which when utilized in combination with the zone detector and annunciator provides that whenever a sensor detector 26 senses an intrusion, the particular sensor housing this detector is identified at the annunciator panel.

How this is accomplished in one embodiment is now described. As mentioned hereinbefore, the sensors and the control unit are provided with counters herein illustrated by counters 30 and 32. These counters may in general be conventional shift registers which are commercially available, or in fact any type of counter or equivalent which is incremented with clock pulses may be utilized. In order to increment counter 30 and 32 simultaneously, a pulse generator 34 provides pulses along line 36 through a switch 38 controlled by a control unit 40 to a line 42 which is connected in parallel to each of the sensors. A pulse detecting unit 44 is provided at each sensor to detect the occurrence of these regular pulses and to provide signals on a line 46 to counter 30 and to one input terminal of a multi-terminal AND gate 48. AND gate 48 has another of its input terminals coupled to a latching circuit 50 which is connected to detector 26. This latching circuit provides a continuous signal once detector 26 has sensed an intrusion or any predetermined alarm condition. The third input terminal to AND gate 48 is connected to one of the output terminals of counter 30. As mentioned hereinbefore, the output terminal to which the AND gate is connected identifies the particular sensor in that each sensor has an AND gate coupled to a different counter output.

It will be appreciated that latching circuit 50, detector 26, and AND gate 48 are conventional, as is pulse detector 44, which may include a one shot multivibrator. Pulse detector 44 also generates a reset pulse over line 50 to reset counter 30 responsive to an elongated pulse delivered over line 42. The detection of the elongated pulse may conventionally be accomplished at the sensor through the utilization of a simple capacitor charging circuit along with a comparator which compares the capacitor voltage to a predetermined voltage. When pulse generator 34 transmits short pulses, it will be appreciated that the capacitor may be arranged so as to be charged with the series of pulses. However with an elongated pulse, the capacitor will finally reach a predetermined threshold and the comparator will generate a reset pulse which is coupled to counter 30.

The reset pulse generating system is illustrated by counter control unit 54 coupled to pulse generator 34 via line 56. This counter control unit may merely count the number of pulses produced by pulse generator 34 and produce an elongated pulse over line 58 after a number of pulses corresponding to the total shift register count has been received at the counter control unit. The elongated pulse on line 58 may be coupled to line 42 via switch 38 through the utlization of control unit 40 which senses the presence of a pulse on line 58. Concomitant with the production of an elongated pulse of line 58, a reset pulse is applied over line 60 to counter 32 to reset this counter.

Pulse generator 34 may be separately provided or in systems which utilize regularly occurring freeze pulses, the freeze pulse may itself be utilized by the pulse detector 44 instead of providing a separate pulse generator. The freeze pulses, while utilized elsewhere, have a dual purpose in that they are used for the zone indicating system as well as for freezing all sensors to permit a walk-by inspection once the system has been tripped. This type system will be described in connection with FIG. 5.

Referring again to FIG. 2, the output of AND gate 48 is a signal which when produced indicates that an alarm condition exists at a particular sensor. It will be appreciated that AND gate 48 is enabled by the simultaneous occurrence of an alarm condition indicating signal from latch 50, an output pulse from counter 30 and a pulse over line 46. It will therefore be appreciated that during that cycling of counter 30, AND gate 48 is enabled only once during the cycle period and for a duration equal to the length of the pulses generated by pulse generator 34.

The output of AND gate 48 is applied over a line 64 back to control unit 10 where the alarm signal is detected at an intrusion sensing and alarm subsystem 66 within the control unit. Simultaneously, this alarm indicating signal is provided in parallel to one terminal of two terminal AND gates 68. Each AND gate 68 has its other terminal coupled to a different output of counter 32. Thus for every output for counter 32 there is an associated AND gate, with the AND gates having one of their input terminals being fed in parallel by an alarm condition indicating signal along line 64.

The simultaneous presence of an alarm indicating signal on line 64 with an output pulse from counter 32 produces an output pulse at the corresponding AND gate 68. The output of this AND gate is applied to a corresponding latch 70 and thence to a corresponding indicating device 72 within the annunciator panel 22. In one embodiment, the annunciator panel may merely be a series of light emitting diodes (LEDs) which are marked so as to correspond one each to a different sensor.

In operation, pulse generator 34 simultaneously provides pulses to counters 30 and 32 such that these counters step through or increment through their counts in synchronism. If the counters are in the form of shift registers, each counter has outputs which are sequentially enabled such that the corresponding AND gates, latches and LEDs are sequentially enabled. Simultaneously, counter 30 steps through the same sequence and should there coincidently be a detector signal, a counter output signal and an output signal from the pulse detector of the sensor, the sensor AND gate will place a pulse or some other signal on line 64. This is sensed at zone detector 20 insofar as the corresponding AND gate in the control unit will also be enabled and an AND gate 68 pulse will appear with the simultaneous presence of a signal on line 64 and a particular counter output. This causes the annunciator panel to be actuated to provide the appropriate indication, indicating not only an alarm condition but the location that the alarm condition was sensed.

After the counters have been stepped through a cycle, a reset pulse is transmitted and the cycling of the counters begins again.

It will be appreciated that any type of alarm condition may be sensed by sensor 12 and the fact of an alarm condition existing may be transmitted over any line back to the control unit. It will also be appreciated that only existing lines need be utilized, since every intrusion alarm system has at least one wire carrying an alarm condition indication. It is the simultaneous occurrence of this alarm condition indication with a particular counter output which establishes the identity of the sensor at which the alarm condition is sensed.

Alarm conditions may be in the nature of intrusion, such as sensed with open switches on doors, windows, etc., may be the output of ultrasonic detecting means, or may be the result of a tampering or bridging attempt.

Figure 3:
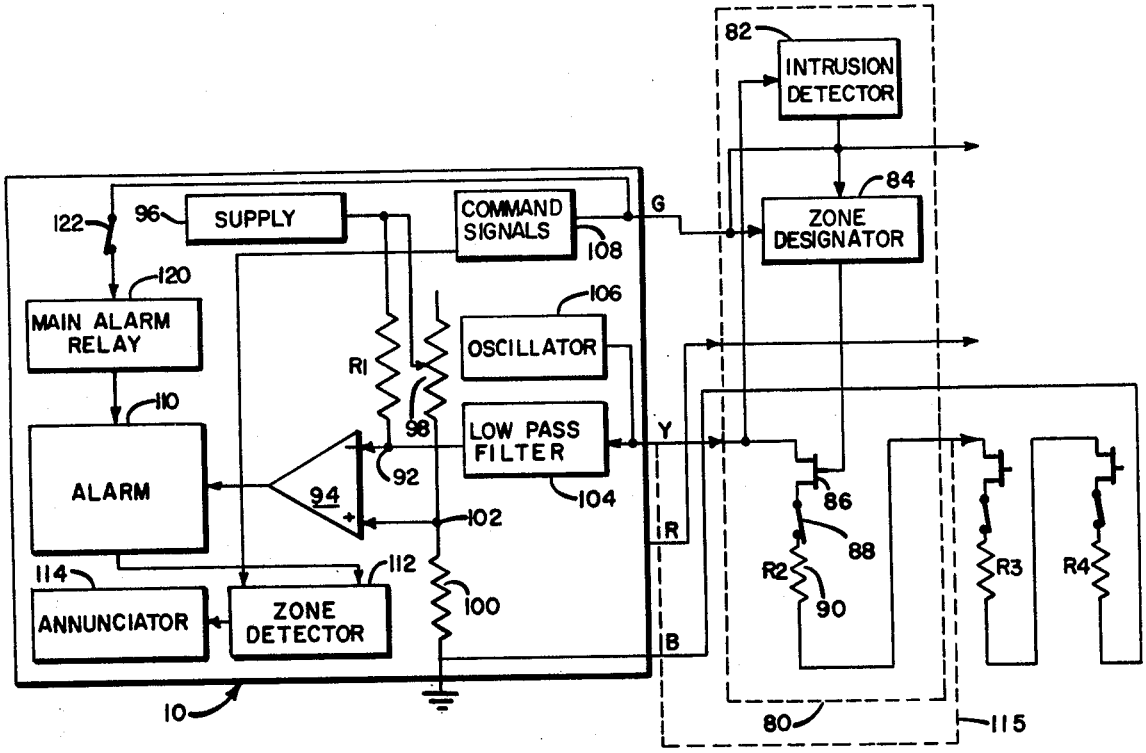
FIG. 3 is a schematic and block diagram illustrating an anti-bridging and anti-tamper circuit for use in an alarm condition indication system provided with non-home run zoning.

Referring now to FIG. 3 what is illustrated is a system which utilizes an anti-tampering, anti-bridging line as one of the alarm lines for the system. In this embodiment, a sensor 80 may include an intrusion detector 82 which may include a number of different types of detecting circuits. The first of these detecting circuits may be the conventional intrusion detecting circuit such as switches and ultrasonic circuits. Alternatively, or additionally, a detecting circuit may include a circuit which detects wire tampering or bridging. This circuit detects either open wires or shorts between the wires of the multi-wire cable utilized to connect the sensors together and to the control unit. Additionally, this latter circuit can detect bridging of a sensor.

It will be appreciated that one of the ways of rendering an intrusion alarm system inactive is to bridge out a given sensor by connecting wires fore and aft of the sensor location and then to cut out the sensor by cutting the wires to this sensor. Several systems have been proposed which monitor the conditions of the wires going to a particular sensor so as to monitor either open wire conditions or shorts, and the condition of a wire is in fact an alarm condition which can be sensed and provided back to the control unit.

Sending back any type of alarm indication is accomplished by a zone designator 84 which may be similar to zone designator 24 of FIG. 2. The output of zone designator 84 in one embodiment is utilized to turn off a switching device, herein illustrated by a field effect transistor (FET) 86, which is placed in series with a case tamper switch 88 and a resistor 90 within sensor unit 80. In one embodiment, the anti-tampering, anti-bridging circuit utilizes the aforementioned yellow line. In order to use this line, D.C. signaling is superimposed on the A.C. signals normally carried by this line, with low pass filtering utilized to recover the D.C. signals at the control unit.

The manner of detecting an alarm condition on the yellow line is now described. As illustrated, a resistor string is made up of $R_1$ in control unit 10, $R_2$ in sensor 80 and resistors $R_3$ and $R_4$ in various other sensors. Resistors $R_1$, $R_2$, $R_3$, and $R_4$ are connected in series by virtue of the connection of the sensors to the yellow line. The return path is back through the ground wire, in this case, the black wire. This resistor string provides a voltage dividing network having a node 92 between resistor $R_1$ and $R_2$ which is connected to the inverting input terminal of a conventional comparator 94. The non-inverting input terminal to this comparator is supplied with an adjustable voltage from a supply 96 via a voltage dividing network including a potentiometer 98 and a resistor 100 coupled between supply 96 and ground. A node 102 between potentiometer 98 and resistor 100 is coupled to the aforementioned non-inverting input terminal.

When ultrasonic detectors are used, it will be appreciated that a low pass filter 104 is provided to filter out the effects of an AC signal generated by an oscillator 106 when an oscillator is necessary to power ultrasonic detectors at the sensors.

In operation, should any alarm condition be detected at 82 by whatever means, the corresponding FET is turned off by a zone designator 84. This zone designator has an AND gate which provides a signal responsive to the simultaneous presence of an output signal from intrusion detector 82 and a pulse from a pulse generator within control unit 10. In one embodiment, the pulse generating unit is a unit 108 for generating command signals of which freeze pulses are a part. When a particular field effect transistor is rendered nonconductive, there is a significant voltage imbalance at comparator 94 which actuates alarm 110. The actuation of alarm 110 is detected by zone detector 112, of the same type as zone detector 20 of FIG. 2, which actuates the appropriate annunciator 114 lamp so as to indicate the location or zone of the intrusion.

With respect to bridging, a bridging attempt for instance on the yellow line as illustrated by a dotted line 115 in effect shorts out resistor $R_2$ and likewise causes an imbalance at comparator 94. This results in an alarm being sounded and the annunciator panel indicating the location of the bridging attempt.

What has been described thus far is the provision of an alarm indicating signal on one of the wires not normally utilized for providing an alarm indicating signal. In fact in the embodiment discussed, the yellow wire is utilized for detecting tampering and bridging whereas the green wire may be utilized to develop signals only related to conventional intrusion detection. In general, intrusion detectors when detecting an intrusion may merely ground out the green line. This grounding is detected at a main alarm relay 120 within control unit 10. This actuates alarm 110, with the actuation of alarm 110 being detected by zone detector 112 and annunciated at 114. Thus what has been provided is a redundant system in which any type of alarm condition will be indicated on the yellow tamper line, whereas conventional intrusions will be simultaneously detected on the green line.

Of course during the day it may be undesirable to detect motion within a given zone and the green line indication may be interrupted as by switch 122, whereas either case tampering or wire tampering during the day is indicated and annunciated as described. At night switch 122 is closed and any tampering, bridging or intrusion is indicated by this redundant system.

Figure 4:
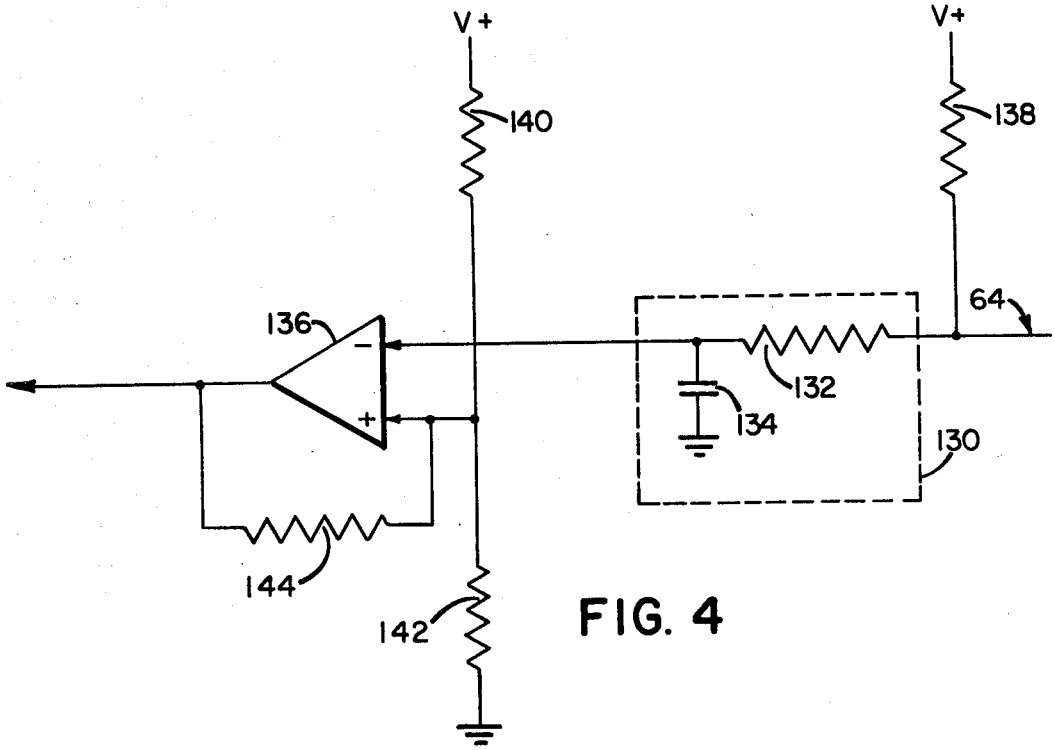
FIG. 4 is a schematic diagram of one embodiment of a low pass filter system for use in the system of FIG. 2.

Referring to FIG. 4 assuming the presence of AC signals on a line utilized as an alarm line, a low pass (LP) filter 130 may be inserted in the line which includes an RC circuit 132,134 as illustrated. Assuming that AND gate 48, rather than being coupled to the aforementioned FETs of FIG. 3 is coupled directly to line 64 as illustrated in FIG. 2, and assuming that AND gate 48 normally produces a logic level 1 signal for a no intrusion indication and a ground or logic level 0 signal for an intrusion indication, then prior to actuating AND gates 68 of FIG. 2 directly with the AND gate 48 signal a comparator 136 is interposed. This comparator is coupled to the line 64 signal in that its inverting input terminal is provided with a signal which is the output signal from low pass filter 130. A positive voltage is applied to the inverting input signal via resistor 138 such that if line 64 is not grounded the inverting input signal is at V+.

The non-inverting input terminal to the comparator is provided with $\frac{1}{3}$V+ by virtue of a voltage dividing network composed of resistors 140 and 142 coupled between V+ and ground as shown. A feedback resistor 144 is provided to provide the entire circuit with hysteresis such that if an oscillator signal is on line 64, the circuit does not respond fast enough, e.g. does not respond to the individual cycles of the carrier signal on this line. When line 64 is grounded, the inverting input terminal drops to 0 volts and this is sensed by the comparator, an output signal of V+ is applied, in the case described above to AND gates 68. In this manner, AC signals are completely filtered and the grounding of line 64 in FIG. 2 is translated into a positive voltage applied to AND gates 68 within the control unit.

What has therefore been provided is a zone indication system in which the areas or zone of an intrusion is annunciated with simple circuitry and by utilizing only the existing wires in a multi-wire cable. This system may be added to any existing intrusion detection system, such that in-place intrusion detecting systems may be retrofitted with a zone annunciator. Depending on the type of system utilized, redundancy can also be built in.

RETROFITTING WITH NON-HOME RUN ZONING

Before entering into a detailed description, one type of presently available four wire intrusion detection system is described in general terms. The system includes a control unit and a number of sensors connected in parallel across the four wires. Each of the sensors has in one embodiment, an ultrasonic detector which is actuated by a 26 kiloHertz signal. Note that in one type system each sensor has a local indicator to display the tripping of an alarm and it is used as a walk test indication that the sensor has latched.

The four wires are utilized as follows: Two of the wires are used to supply DC power to the sensors; the third wire is used to supply 26 kiloHertz signals and the fourth wire is used for bi-directional control and alarm signaling. The 26 kiloHertz signal is used to provide each sensor with a signal to be radiated into the protected area. The 26 kiloHertz signal provided to each sensor is reconstructed with a comparator circuit, With the function of the comparator circuit to restore the 26 kiloHertz level at each sensor. This comparator is essentially a DC comparator which takes the 26 kiloHertz signal from the cable and converts it into sharp edged square waves at each sensor.

The signal line is a bi-directional line and the signals that come from the control unit to the sensors are voltage level signals which control the local display function at each sensor. There are three states that are used on the signal line. The highest voltage is used to reset the local display. The middle voltage is used to allow the local display to latch and remain in latch whenever an alarm condition occurs until reset by the aforementioned high voltage. The third and lowest voltage is used to freeze the local display in whatever state it was in at the time that the freeze signal is placed on the wire. The purpose of the freezing of the local display is to provide normal system operation without disturbing the state of the display. In other words a responding guard can place the system in freeze and then walk through the protected area without changing the local displayed information and without affecting the normal operation of the rest of the system. Thus alarm information at the central station is not affected. The principal usefullness would be in finding a false alarm problem and being able to isolate it to a particular sensor.

The alarm information is returned from the sensor on the same wire that is used for the local display control. The signal back to the control unit consists of a current drawn from the control unit by whichever sensor has alarmed. The control unit has a voltage source coupled to the signal wire which maintains the tri-level voltage signaling regardless of what current is drawn from the control unit down the signal wire. This allows the sensors to provide an alarm signal without disturbing the local display control. When there is a local alarm, the sensor draws a current from the signal wire and this current is sensed at the control unit as an alarm.

The aforementioned voltage source has within it a monitoring resistor and a comparator. As the voltage source supplies increasing current to maintain the signal line at the proper voltage, this fact is detected by a sensing resistor and a comparator. When this current exceeds a certain value, the comparator initiates an alarm. Note that normally there is no current drawn in the line except for certain stray bias currents in some comparator input stages which amount to very, very low microampere type currents. In one embodiment, during an alarm the current drawn is determined by the fact that each sensor switches a resistor across signal line to ground. Thus, the comparator is made sensitive to the current which would be drawn by the lowest signal voltage when the resistor is switched between the signal line to ground.

Figure 5:
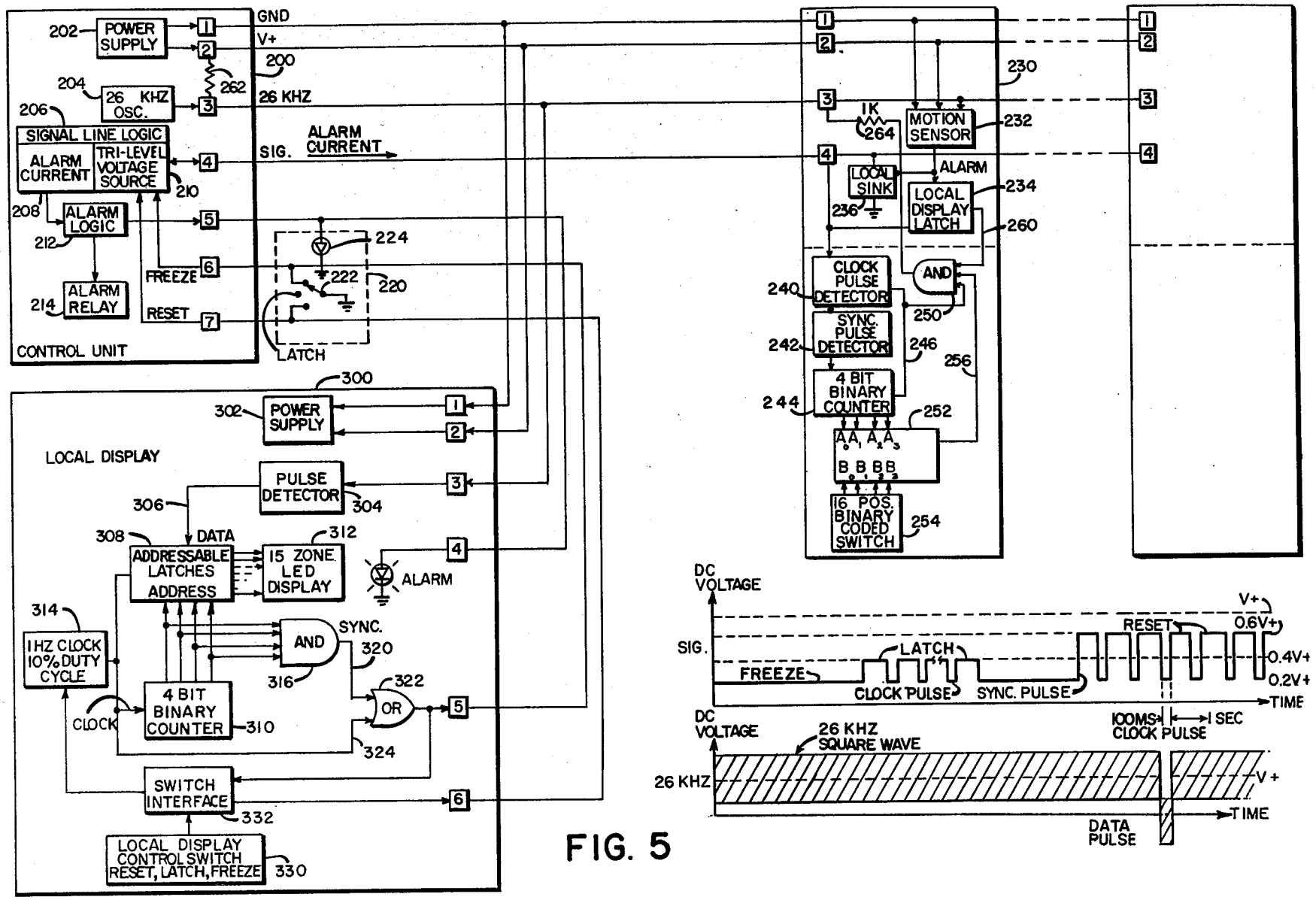
FIG. 5 is a block diagram of a retrofitting system for use with an in-place four wire intrusion detection system; and, FIG. 6 is a block diagram of an expanded capacity monitoring and control system utilized for remote data aquisition and control, which also utilizes a four wire cable.

Referring now to FIG. 5, the remote monitoring system described includes a control unit 200 which is provided with a power supply 202, a 26 kiloHertz oscillator 204, a signal line logic unit 206 which includes an alarm current detector 208 and a tri-level voltage source 210. An alarm logic unit 212 is connected to the alarm current detector and an alarm relay 214 is driven by the alarm logic unit. The outputs to the power supply are to terminals 1 and 2 as illustrated; the output of oscillator 204 is connected to terminal 3 and the output of signal line logic unit 206 is connected to terminal 4. In the non-retrofitted system a unit 220 is provided which includes a three position single pole, center-off switch 222 having its outer contacts coupled respectively to terminals 6 and 7 of control unit 200 and having its center contact grounded. An LED or other like display device 224 is coupled to terminal 5 of control unit 200. With respect to indicating device 224, whenever an alarm condition signal is indicated at the control unit, this device is actuated.

With respect to switch 222, the grounding of terminals 6 or 7 results in a different DC voltage level being applied at terminal 4. With the switch in the position shown, a DC level indicating a freeze level is provided at terminal 4. In the center position, which is the off position, the latch level signals are provided and in the lower position a reset level is applied to terminal 4.

Referring now to one of the sensors of such an existing system, the sensor here is illustrated within box 230 to include a motion sensor 232 connected for its power supply and ultrasonic signals to terminals 1, 2 and 3 as illustrated. The output of the motion sensor is in general coupled to a local display latch circuit 234 and to a current sink 236 which upon being provided with an alarm signal draws current from the signal line as discussed below.

In order to provide such a system with a non-homerun zoning indication, the sensor 230 is provided with a clock pulse detector 240 coupled to a sync pulse detector 242, coupled in turn to a 4 bit binary counter 244 with the output of the clock pulse detector also coupled over line 246 to clock the 4 bit binary counter and to an AND gate 250 which is a three input terminal AND gate.

The output of the binary counter is coupled to a 4 bit magnitude comparator 252 which is in turn driven by a 16 position binary coded switch 254.

In operation, the clock pulse detector detects the negative going portions of the signals on the signal line corresponding to the beginning of a freeze pulse which in the object system, is generated on a periodic basis. The output of the clock pulse detector is fed to the sync pulse detector which detects a long freeze pulse for resetting the 4 bit binary counter. Otherwise the signals from the clock pulse detector are fed directly to the binary counter for clocking it.

It will be appreciated that the clock pulses detected by pulse detector 240 are applied as the clock pulses to counter 244 via line 246, with the signal from sync pulse detector 242 being only provided during the occurance of a long freeze pulse.

The 4 bit magnitude comparator 252 functions as follows. When the output of the 4 bit binary counter equals that code which is set by the 16 position binary coded switch, then an output signal is provided over line 256 to AND gate 250. The other input to AND 250 is an output from local display latch circuit 234, the occurrance of which indicates an alarm having occurred at the sensor. This is applied over line 260 to AND gate 250.

Upon the simultaneous occurrence at AND gate 250 of a clock pulse which is in the nature of the normal periodically generated freeze pulse, an output from the 4 bit magnitude comparator and an alarm condition signal, AND gate 250 is actuated to draw current from terminal 3 of the sensor. This provides a negative going voltage superimposed on the 26 kiloHertz signal on the signal line. This is accomplished by providing that a 10K resistor 262 be provided between terminal 2 and terminal 3 of the control unit and by providing a 1K resistor 264 between the output of AND gate 250 and sensor terminal 3. It will therefore be appreciated that an alarm condition signal is now available not only on the signal line at control unit terminal 4, but is also available on the 26 kiloHertz line at control unit terminal 3.

The control unit zone indication add-on for the non-homerun zoning for local display 300 is connected as can be seen across terminals 1, 2 and 3 of the original control unit. Unit 220 is eliminated and terminals 5, 6 and 7 of the control unit are coupled to terminals 4, 5, and 6 respectively of local display 300. It will be appreciated that local display 300 includes 6 terminals and is connected to 6 terminals of the control unit. While oftentimes it is convenient to locate the local display adjacent to the control unit, it will be appreciated that as an added feature, the local display unit may be connected anywhere in the system as long as there is a six conductor cable available between it and the control unit. This may necessitate running only three additional cables to the control unit as the three other cables are normally supplied as will be seen by the four conductor interconnect cable between the control unit and the sensors.

Power for local display 300 is provided via terminals 1 and 2 thereof to a power supply 302 internal to the display. Thus terminals 1 and 2 of the local display unit are coupled to terminals 1 an 2 of the control unit.

Terminal 3 of the local display is connected to terminal 3 of the control unit and is utilized to detect alarm condition signals. In order to accomplish this, a pulse detector 304 is coupled to terminal 3 of the local display and it is utilized to sense the aforementioned negative going voltage on the 26 kiloHertz line. This is done conventionally by the utilization of filtering circuits and threshold detecting.

The output of detector 304 is applied over line 306 to addressable latches 308 which are driven by a 4 bit binary counter 310 of similar nature to the 4 bit binary counter 244 in the sensors. The outputs of the addressable latch circuit are applied to a fifteen zone LED display 312.

The local display unit is driven by a 1 hertz clock 314 which has a 10% duty cycle. The output of clock 314 clocks 4 bit binary counter 310 and is also connected to the addressable latches. The output of binary counter 310 is provided to a 4 input AND gate 316 for generating the sync pulse, e.g. the elongated freeze pulse. This is applied over line 310 to an OR gate 322. The output of the clock is also applied over line 324 to OR gate 322 the output of which is routed to terminal 5 of the local display which is connected to terminal 6 of the control unit. This is the freeze pulse line. Sending regular clock pulses over the freeze pulse line drives the tri-level voltage source to produce the low voltage level freeze pulses on a regular basis, which freeze pulses are the clock pulses for the 4 bit binary counters in the sensors. Thus it will be seen that the 4 bit binary counters in the local display and the sensors are driven simultaneously by the freeze pulses.

Local display 300 is also provided with a local display control switch to provide for either reset, latch or freeze signals. This switch is diagramatically illustrated at 330. The output of this switch is provided to a switch interface 332. Normally the local display control switch 330 is in the latch position. In this position, there is no signal applied to terminal 6 and the freeze pulses which are the clocking pulses are transmitted from local display at terminal 5 to terminal 6 of the control unit for the sequential actuation of the sensors. When it is desirable to reset the entire system, switch 330 is switched such that terminal 6 is grounded. However, ground is released when the output of OR gate 322 is low, such that clock pulses continue to be generated over the signal wire. When it is desirable to freeze the system, switch 330 is switched to the freeze position which in essence freezes clock 314. When this is done, a continuous sync pulse is produced which resets all the counters to zero.

Referring to the wave forms to the lower right of this figure, it can be seen that initially there is a long freeze pulse which resets the counters. This is followed by a latch level signal followed by a clock pulse, followed by another latch level signal. It will be appreciated that short freeze pulses are generated until such time as 16 have been generated, at which point a sync pulse, which is an elongated freeze pulse, is generated. The system may be reset at any time by providing a reset signal. As illustrated the reset signal is momentarily interrupted by clock pulses. The reason the clock pulses are allowed to override the reset pulse is to maintain the clocking of all of the counters, while resetting the local display latch.

With respect to the freeze pulses, the reason for choosing the freeze pulses as the system clock, is because the freeze pulses will not reset the local display and will not interfere in any noticable way with the walk testing of the equipment as long as the pulses are kept short relative to the perceived operation of the local display indicator. The reason for using the negative going voltage for the clock pulse is because the original protocol selected for the signal line used the negative going pulse for freezing the display. Momentary freezes of the local display will in no way interfere with the walk testing of the equipment as long as they are kept at the 100 millisecond type time as indicated in the timing diagram.

Note, the sync signal is used to reset the counters that are used for the non-home run display. Moreover, the non-home run display runs independently of the local display latch and is used to provide a remote indication of what the state of this latch is without disturbing any of the previous functions that were defined in the original system.

The reset pulse is to reset the local display latch. It this embodiment, the reset is a DC level which is used to reset the local display latch, whereas the sync pulse is utilized to reset the counters for the non-home run zoning. The sync pulse occurs once every 16 clock pulses and resets the counter to insure that even if a stray noise pulse is fed into the system it would not interfere with the performance of the remote displays for more than one cycle of the clock count. Thus, each cycle of the binary counters is reset to start over again each cycle.

A feature of adapting the non-home run zoning to the aforementioned system is that the freeze signal can be utilized for more than one purpose. Originally the freeze signal was utilized to freeze the entire system so that a walk-by could be accomplished. Here the freeze signal is still utilized for the same purpose. However by pulsing the freeze signal, it is now utilized as a clock pulse for the non-home run zoning without affecting the normal operation of the previous unit. This means that even when the display latch is reset, the freeze pulses do not affect either the resetting procedure for the local display latch, or visually impare a reading during a walk-by. Another of the features of this add-on system is that when non-home run zoning is not required for a given situation, the older sensors may be coupled without regard to any non-home run zoning. This is because the original functions of freeze, latch and reset are not disturbed regardless of the fact that in the latch condition there are momentary returns to the freeze level, and regardless of the fact that during reset there are momentary returns to the freeze level.

In short, the older sensors which may be applied to the line for a local display latching situation do not respond to the signals which are placed on the lines to provide for non-home run zoning.

EXPANDED CAPABILITY SYSTEM

Figure 6:
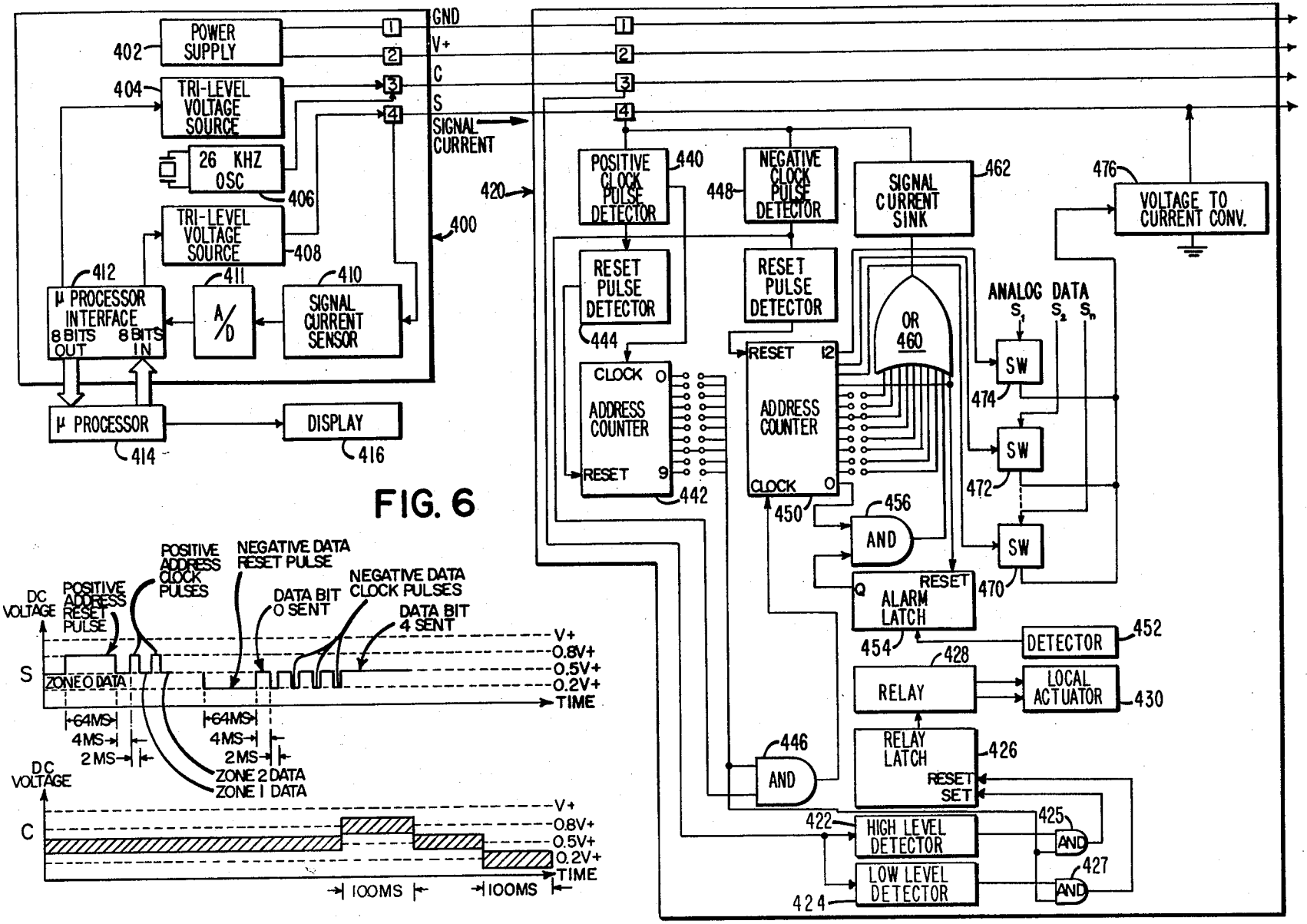

Referring now to FIG. 6, a four wire system is illustrated which is capable of providing not only an expanded alarm and security function, but is also capable of transmitting analog data gathered at a remote location back to the control unit. Referring now to FIG. 6, a control unit 400 includes the usual power supply 402, the aforementioned tri-level voltage source 404, a 26 kiloHertz oscillator 406, and a second tri-level voltage source 408 coupled respectively to terminals 1, 2, 3 and 4 of control unit 400. Also coupled to terminal 4 of the control unit is a signal current sensor 410 which is coupled via an analog-to-digital converter 411 to a micro-processor interface 412. The micro-processor interface includes control lines to tri-level voltage source 404, oscillator 406 and tri-level voltage source 408. The micro-processor interface in one embodiment is capable of 8 bits in each direction to and from a micro-processor 414 which is coupled to a display 416. In one embodiment, micro-processor 414 is an Intel 8080. Coupled to the control unit are a number of sensor/actuator interfaces, one of which is diagramatically illustrated at 420. The sensor has four input terminals as illustrated which couple the ground and V+ lines as well as the control signal lines to the sensor. Coupled to terminal 3 of the sensor is a high signal level detector 422 and a low signal level detector 424, the outputs of which are respectively connected to AND gates 425 and 427 and thence to the set and reset terminals of a relay latch 426, which is in turn connected to a relay 428. AND gates 425 and 427 are actuated by an output from an address counter 442, to be described hereinafter, when sensor 420 is addressed. Relay 428 is in turn connected to a local actuator or utilization device 430. Note that by signaling this particular relay, the action of the corresponding device is controlled. Thus the relay may be used for instance for turning on and off motors, lights etc.

Coupled to the signal line, terminal 4 of the sensor interface, is a positive clock pulse detector 440, the output of which is coupled as a clocking input to an address counter 442. Coupled to positive clock pulse detector is a reset pulse detector 444 which is responsive to the aforementioned elongated pulse so as to reset the appropriate counter. The output of counter 442 is connected via an appropriately positioned jumper pin to AND gate 446. The other input of AND gate 446 is coupled to a negative clock pulse detector 448 which is coupled to the signal line via terminal 4 of the sensor.

In operation, positive clock pulses are detected at 440 and counter 442 is clocked accordingly. A jumper pin at a predetermined output corresponding to the address of the sensor interface connects the output of this counter to ANd gate 446. When counter 442 has counted to the count indicated by this jumper pin, the particular sensor has been addressed. Thereafter, should there be a negative clock pulse on the signal line, this is detected at detector 448 and the simultaneous occurrence of an output from counter 442 with the detection of a negative clock pulse clocks an auxiliary counter 450. If the control unit is to read out this particular sensor, and if the control unit is to read out more than one kind of data from the particular sensor addressed, the positive clock pulse is maintained at the input to AND gate 446 and a series of negative clock pulses are then generated so that the output of AND gate 446 clocks the auxiliary counter. It will be appreciated that one way of maintaining the positive clock input on AND gate 446 is merely to inhibit the clock pulses by returning the clock pulse signal to zero for the required length of time. This is recognized by the clock pulse detector as freezing counter 442 such that a logic level high signal is available when it is frozen. This high logic level signal is applied to AND gate 446.

As illustrated, auxiliary counter 450 provides for a number of different functions. In the first instance it may provide that an alarm condition detected at 452 when latched at 454 and ANDed at 456 with a zero count from the counter will be coupled to an OR gate 460 as an indication that an alarm condition has occurred. It will be appreciated that when counter 450 is reset, its zero output is high. Thus any detected alarm and latch condition will result in a signal being applied to OR gate 460. Thereafter should it be desirable to be able to poll the sensor to find out what type of alarm this was, or on what basis it was generated, a jumper pin may be connected between an output of auxiliary counter 450 and one of the input lines to OR gate 460. For instance, if this sensor is a burglar alarm as opposed to a fire sensor, then a single pin is placed between the appropriate output of the counter and an input to OR gate 460. Thus the type of alarm condition may be sensed after the fact that alarm condition has occurred, when there is a second signal from the OR gate coincident with a predetermined auxiliary clock pulse.

The output of OR gate 460 is applied to a voltage-to-current converter 462 which in essence may be any type of controllable current source which draws a current from the signal line to the control unit. Current drawn in this manner is sensed at 410 and provided as an input signal to the micro-processor interface 412. As will be described hereinafter, this signal is correlated in time with states of registers in micro-processor which indicate the address of the sensor at which an alarm condition has occurred, and what type of alarm condition it represents.

Should it be desired that the sensor also sense any one of a number of local analog conditions, the counter may be counted up beyond the alarm sensing counts to counts, in this case 9-12 which sequentially actuate switches 470, 472 and 474 to couple sensed analog data to a further voltage-to-current converter 476 for transmission back to the control unit.

Referring now to control unit 400, it will be appreciated that tri-level voltage source 404 can produce three different level signals as illustrated by the C-line graph at the bottom of this figure. The purpose of one of these signals is to control relay 428. In the embodiment shown, this C-line transmits a 26 kiloHertz square wave carrier which is centered about a plus 0.5 V+ level which is half of the supply voltage V+ that appears on terminal 2 of the control unit. The appearance of this carrier centered about to 0.5 V+ is the quiescent state of the signal. Tri-level voltage source 404 goes high to set the relay latch. The high level signal is centered about 0.8 V+ and is detected by high level detector 422 which sets the relay latch. This turns on the relay for whatever control function is desired.

In order to reset the relay, a voltage which is centered around 0.2 V+ is applied to the C-line and the relay is deactivated.

With respect to the signaling along the S-line, this signal is likewise produced by a tri-level voltage source, but the control functions are quite different. As can be seen from the S-line waveform in the diagram immediately above the C-line waveform diagram, both positive and negative pulses are used as clock pulses. The positive pulses are for the address counter and negative pulses are for the auxiliary counter. Elongated positive or negative pulses are utilized as reset pulses whereas short pulses are used as clocking pulses for these counters.

In operation, a positive reset pulse may be applied to the S-line, for instance for 64 milliseconds. This results all address counters for all of the sensors. When the positive elongated reset pulse goes negative, this does so for approximately 4 milliseconds at which time data corresponding to zone zero, if it exists at all, may be provided back along the signal line. Thereafter, after a dead time, which in this embodiment is 4 milliseconds, a clock pulse which corresponds to the address of the first sensor, is provided on the S-line. This clock pulse is in one embodiment, 2 milliseconds long. There is a 4 millisecond dead time after the production of the first positive clock pulse in which time data may be received back along the S-line. A series of positive pulses is produced until a particular sensor has been addressed, the information form which is desired. At this point a negative-going elongated reset pulse is applied to the S-line and thereafter a series of negative-going clock pulses are applied as described hereinbefore to the auxiliary counter, thereby to readout the data determined by one or more jumper pins. The data is readout between the production of the negative-going clock pulses during the 4 millisecond dead time interval.

However, in the case of transmitting analog data, this may be too short a period of time. In order to accommodate analog data transmission the positive-going clock pulses may be inhibited so as to accommodate as many negative-going clock pulses as necessary. Then the negative-going pulses may be selectively inhibited to accommodate the transmission of analog data. The 4 milliseconds spacing between the positive or negative-going clock pulses is in general a minimum spacing. Thus the system may be operated in two fashions. First, positive-going clock pulses with a predetermined spacing may be sent out with the negative-going pulses interspersed between two positive clock pulses without inhibiting the positive-going clock pulses. Alternatively, an individual sensor may be addressed by producing a given number of positive-going clock pulses and then the positive-going clock pulses are inhibited until such time as all of the data that is required is read out from that sensor. The first case corresponds to a strobing of all of the sensors, whereas the second case corresponds to an addressing of a sensor followed by a subsequent read out of all of the data that is required. Thus for instance, while for the general case an interpulse spacing for the positive pulses may be as long as 25 milliseconds to accommodate the worst-case situation, should a more efficient system be required in which sone sensors do not need this much time to output information, this interpulse spacing may be shortened.

It will be appreciated that the signalling system thus described permits the accommodation of the transmission and reception of a large amount of data on four wires. It will be further appreciated that while there is usually one control unit per system, there are a large number of sensors. It is therefore important to design the sensor in the most efficient way possible so that the largest amount of data can be accommodated and the widest variety of envisioned situations can be accommodated.

Having above indicated a preferred embodiment of the present invention, it will occur to those skilled in the art that modifications and alternatives can be practised within the spirit of the invention. It is accordingly intended to define the scope of the invention only as indicated in the following claims.

What is claimed is:

1. A zone indication system for use with multiple sensors and a multiwire interconnect cable between a monitoring location and a monitored location, comprising:

a control unit having a counter which provides output signals, one each for each count thereof, and means for clocking said counter with a first set of clock pulses and for simultaneously applying said clock pulses to said multiwire cable, said control unit further including means for applying to said multiwire cable a second set of clock pulses interspaced between said first set of clock pulses, said second set of clock pulses being distinguishable from said first set; and, a sensor coupled to said multiwire cable at said monitored location, said sensor including first and second counters coupled to said multiwire cable, said first counter connected so as to be clocked by the first set of clock pulses applied to said multiwire cable such that said control unit counter and said first counter are simultaneously clocked with said first set to clock pulses, said first counter providing output signals, one each for each count thereof, and means responsive to a selected one of said first counter output signals for activating said second counter, said second counter being connected to said multiwire cable so as to be clocked by the second set of clock pulses, said second counter producing output signals, one each for each count thereof, said sensor including means for generating an information carrying signal responsive to a predetermined condition thereat, and means for applying said information carrying signal to said multiwire cable responsive to the occurrence of a predetermined output signal from said second counter, said control unit including means responsive both to the transmission of said information carrying signal by said cable and to the state of said control unit counter at the time of receipt of said information carrying signal for indicating the presence of said information carrying signal, its content and the identity of the transmitting sensor, said control unit further including means for generating an elongated clock pulse and for applying said elongated clock pulse to said multiwire cable for the resetting of a corresponding counter in said sensor, said sensor further including means for detecting said elongated clock pulse and for resetting said corresponding counter.

2. The system of claim 1 wherein said indicating means is responsive to the transmission of said information carrying signal in the interval between two adjacent pulses of said first set of clock pulses.

3. The system of claim 2 and further including means at said control unit for freezing the production of pulses in said first clock pulse set, whereby time may be provided for the transmission of information from a predetermined sensor.

4. The system of claim 1 wherein said control unit normally generates a signal for use by all sensors coupled to said multiwire cable and wherein said normal signal is modified in different ways to provide said first and second sets of clock pulses.

5. The system of claim 4 wherein said normal signal provides current to said sensors and wherein said modification includes provision of either positive or negative going voltage spikes depending on which of said sets of clock pulses is to be generated.

6. The system of claim 1 wherein said control unit generated a normal signal for use by all sensors, said normal signal being coupled to said multiwire cable, and wherein said normal signal is modified to provide said first and second set of clock pulses.

7. The system of claim 6 wherein said normal signal provides current to said sensors and wherein said modification includes provision of voltage pulses therewith.

8. The system of claim 1 wherein said control unit includes means for coupling to said multiwire cable a control signal responsive to the detection of said information carrying signal, and wherein said sensor includes means for detecting said control signal and for producing an actuation signal responsive to the detection of said control signal and the previous actuation of said sensor.

9. The system of claim 8 wherein said control signal includes a carrier displaced in amplitude in a predetermined direction for a predetermined control function.

10. The system of claim 1 wherein said elongated reset pulses are of a longer duration than any pulse of said first and second set of clock pulses, said control unit further including means for coupling said elongated reset pulse to the same line as that to which said first and second sets of clock pulses are coupled while at the same time removing said first and second sets of clock pulses from said line.

11. The system of claim 1 wherein said information carrying signal conveys information in terms of current flow along one of the lines in said multiwire cable and wherein said control unit includes means for monitoring current flow on said line.

12. The system of claim 11 wherein said sensor includes means for detecting an alarm condition and means responsive to detection of said alarm condition for grounding the line along which current flow is monitored.

13. The system of claim 11 wherein said sensor includes means for monitoring a predetermined condition and means for establishing the amplitude of said current flow in accordance with the monitored condition.

14. The system of claim 1 wherein said sensor is adapted to sense an alarm condition and includes a local display for displaying the occurrence of said alarm condition, said display being latched upon the occurrence of said alarm condition and unlatched upon the occurrence of a predetermined level of one of said first set of clock pulses.

15. The system of claim 14 wherein said control unit includes means for inhibiting said predetermined level from occurring, thereby to permit a walk-by inspection of the local display at a sensor without disturbing the normal clocking and other operations of said sensor.

16. The system of claim 1 and further including at each sensor a terminal board for each counter thereat, each terminal board having a number of pairs of terminals thereon;

means for connecting one terminal of each pair to an output terminal of a corresponding counter at said sensor; and, a jumper pin placed between the terminal board terminal associated with said last mentioned counter output terminal and the associated other terminal of the pair.

17. The system of claim 1 wherein said control unit includes means for generating voltage control signals, means for coupling said voltage control signals to one of the lines of said multiwire cable, and wherein said information carrying signal from a sensor is in the form of current drawn from said one line.

18. The system of claim 17 wherein said voltage control signals include said first and second sets of clock pulses.

19. The system of claim 1 wherein said control unit includes means for coupling a multilevel signal on a line in said multiwire cable different from the one carrying said information carrying signal and wherein each sensor includes a relay and means at said sensor for controlling said relay responsive to the level of said multilevel signal.

20. In a zone indication system for use with multiple sensors coupled to a multiwire cable in which clock pulses are simultaneously applied to a counter in a control unit and through one of the wires of said multiwire cable to a counter in a sensor, means for resetting said counters including means at said control unit for applying an elongated reset pulse to said one wire and means at said sensor for detecting said elongated pulse and for resetting the counter in said sensor.

21. The system of claim 20 wherein said sensor has two counters, wherein said clock pulses include pulses of opposite polarity, and wherein said reset pulse applying means includes means for generating elongated reset pulses of opposite polarity.

22. In a zone indication system having a control unit which transmits over a multiwide transmission line a second set of clock pulses interspaced within a first set of clock pulses;

a sensor coupled to said transmission line and having two counters, each responsive to a different set of said clock pulses, the counter responsive to said first set of clock pulses activating with a predetermined output therefrom the other of said counters, the activation of said other counter and the clocking thereof causing the transmission to said control unit from said sensor a data signal which corresponds to a predetermined output of said other counter, said different sets of clock pulses being of opposite polarity and applied to one wire of said multiwire line, the data signal from said sensor being transmitted to said control unit on the same line as the one carrying said clock pulses to said sensor.

23. In a zone indication system having a control unit which transmits over a multiwire transmission line a second set of clock pulses interspaced within a first set of clock pulses;

a sensor coupled to said transmission line and having two counters, each responsive to a different set of said clock pulses, the counter responsive to said first set of clock pulses activating with a predetermined output therefrom the other of said counters, the activation of said other counter and the clocking thereof causing the transmission to said control unit from said sensor a data signal which corresponds to a predetermined output of said other counter, said control unit including means for applying multilevel control signals to one of the wires of the multiwire line different from the wire carrying the clock pulses, said sensor further including relay means enabled by said predetermined output from the counter responsive to the first set of clock pulses, and controlled by said multilevel signals.

24. In a zone indication system having a multiwire transmission line and a control unit which transmits clock pulses over one wire of said multiwire transmission line to at least one remote unit having data corresponding to the status thereof, said remote unit comprising:

at least one counter receiving said clock pulses in the form of DC voltage pulses from said one wire and being incremented thereby, and providing a corresponding output signal; and means for receiving said counter output signal and for transmitting said data in the form of current pulses when said counter output signal reaches a predetermined count, said current pulses being applied to said one wire.

* * * * *

UNITED STATES PATENT AND TRADEMARK OFFICE

CERTIFICATE OF CORRECTION

PATENT NO. : 4,468,664

DATED : August 28, 1984

INVENTOR(S) : Aaron A. Galvin; John K. Guscott; Martin E. Henderson; Roy L. Harvey It is certified that error appears in the above—identified patent and that said Letters Patent is hereby corrected as shown below:

| | | |
|---|---|---|
| In the Abstract: | | "non-home-run zoning." should read --non-home run zoning.-- |
| Column 1 | Line 50, | "side" should read --site-- |
| | Line 59, | "these systems measures" should read --these systems give the intruder warning that his presence has been detected, and he may take measures-- |
| | Line 63, | "loction" should read --location-- |
| | Line 64, | "bearing" should read --hearing-- |
| Column 2 | Line 47, | ""non-home-" should read --"non-home-- |
| | Line 49, | ""non-home-run" should read --"non-home run"-- |
| Column 4 | Line 28, | "occurrance" should read --occurrence-- |
| | Line 55, | "period. it" should read --period. It-- |
| Column 5, | Line 57, | "desireable" should read --desirable-- |
| Column 6 | Lines 13-14, | "illustrating an anti-bridging" should read --illustrating the activation of an anti-bridging-- |

UNITED STATES PATENT AND TRADEMARK OFFICE

CERTIFICATE OF CORRECTION

PATENT NO. : 4,468,664

DATED : August 28, 1984

INVENTOR(S) : Aaron A. Galvin; John K. Guscott; Martin E. Henderson; Roy L. Harvey It is certified that error appears in the above—identified patent and that said Letters Patent is hereby corrected as shown below:

| | | |
|---|---|---|
| Column 6 | Lines 14-16, | "circuit for use in an alarm condition indication system provided with non-home run zoning;" should read --circuit loop for not only providing an alarm condition indication but also for zone indication;-- |
| | Line 19, | "retrofitting" should read --retrofitted-- |
| | Line 24, | "aquisition" should read --acquisition-- |
| | Line 36, | "a sensor housing." should read --the sensor's housing.-- |
| | Line 45, | "tion, signal," should read --tion signal,-- |
| Column 6 | Line 41, | "be charged with" should read --be charged and discharged with-- |
| Column 8 | Line 59, | "utilized, since" should read --utilized. Since-- |
| | Line 61, | "indication. It" should read --indication, it-- |
| Column 9 | Line 9, | "a detecting circuit" should read --this circuit-- |

UNITED STATES PATENT AND TRADEMARK OFFICE

CERTIFICATE OF CORRECTION

PATENT NO. : 4,468,664

DATED : August 28, 1984

INVENTOR(S) : Aaron A. Galvin; John K. Guscott; Martin E. Henderson; Roy L. Harvey It is certified that error appears in the above—identified patent and that said Letters Patent is hereby corrected as shown below:

| | | |
|---|---|---|
| Column 9 | Line 32, | "anti-tampering, anti-bridging circuit" should read --anti-wire tampering, anti-wire bridging circuit-- |
| Column 11 | Lines 32-35, | "The 26 kiloHertz signal provided to each sensor is reconstructed with a comparator circuit, With the function of the comparator circuit to restore the 26 kilo-Hertz level at each sensor." should read --The 26 kiloHertz signal provided to each sensor reconstructed with a comparator circuit. The function of the comparator circuit is to restore the 26 kiloHertz level at each sensor.-- |
| | Line 57, | "usefullness" should read --usefulness-- |
| Column 12 | Line 5, | "comparator. As the" should read --comparator and as the-- |
| | Line 13, | "microampere type" should read --micro-amperes type-- |
| | Line 66, | "16 position" should read --6 position-- |
| Column 13 | Line 11, | "occurance" should read --occurrence-- |
| | Line 19, | "occurrance of which" should read --occurrence of which-- |
| | Line 60, | "1 an 2" should read --1 and 2-- |

UNITED STATES PATENT AND TRADEMARK OFFICE

CERTIFICATE OF CORRECTION

PATENT NO. : 4,468,664

DATED : August 28, 1984

INVENTOR(S) : Aaron A. Galvin; John K. Guscott; Martin E. Henderson; Roy L. Harvey It is certified that error appears in the above—identified patent and that said Letters Patent is hereby corrected as shown below:

| | | |
|---|---|---|
| Column 14 | Lines 4-5, | "outputs of the address-able latch circuit are applied to a fifteen" should read --output of the addressable latch circuits is a fifteen-- |
| | Line 27, | "diagramatically" should read --diagrammatically-- |
| Column 15 | Line 6, | "is used" should read --is merely used-- |
| | Line 10, | "latch. It" should read --latch. In-- |
| | Line 31, | "impare" should read --impair-- |
| | Line 56, | "control unit 400." should read --central unit 400.-- |
| | Line 57, | "control unit" should read --central unit-- |
| | Line 67, | "diagramatically" should read --diagrammatically-- |
| Column 16 | Lines 5-6, | "connected to AND gates 425 and 427 and thence to the set" should read --connected to the set-- |
| | Lines 7-10, | "428. AND gates 425 and 427 are actuated by an output from an address counter 442, to be described hereinafter, when sensor 420 is addressed. Relay 428 is in turn" should read --428. This is in turn-- |

UNITED STATES PATENT AND TRADEMARK OFFICE

CERTIFICATE OF CORRECTION

PATENT NO. : 4,468,664

DATED : August 28, 1984

INVENTOR(S) : Aaron A. Galvin; John K. Guscott; Martin E. Henderson; Roy L. Harvey It is certified that error appears in the above-identified patent and that said Letters Patent is hereby corrected as shown below:

| | | |
|---|---|---|
| Column 16 | Line 31, | "ANd gate" should read --AND gate-- |
| Column 17 | Line 19, | "9-12" should read --10-13,-- |
| | Line 53, | "results" should read --resets-- |
| | Line 67, | "form which" should read --from which-- |
| Column 18 | Line 33, | "sone" should read --some-- |
| | Line 36, | "signalling" should read --signaling-- |
| Column 18 | Lines 63-64, | "interspaced" should read --interspersed-- |
| Column 19 | Line 6, | "set to" should read --set of-- |
| | Line 56, | "generated" should read --generates-- |

UNITED STATES PATENT AND TRADEMARK OFFICE

CERTIFICATE OF CORRECTION

PATENT NO. : 4,468,664

DATED : August 28, 1984

INVENTOR(S) : Aaron A. Galvin; John K. Guscott; Martin E. Henderson; Roy L. Harvey It is certified that error appears in the above—identified patent and that said Letters Patent is hereby corrected as shown below:

| | | |
|---|---|---|
| Column 21 | Line 14, | "multiwide" should read --multiwire-- |
| | Line 15, | "interspaced" should read --interspersed-- |
| Column 22 | Line 1, | "interspaced" should read --interspersed-- |
| | Line 14, | "multiwire line" should read --multiwire cable-- |

Signed and Sealed this

Sixth Day of May 1986

[SEAL]

*Attest:*

DONALD J. QUIGG

*Attesting Officer*

*Commissioner of Patents and Trademarks*